United States Patent [19]

Eisenberg

[11] Patent Number: 4,754,785

[45] Date of Patent: Jul. 5, 1988

[54] METHOD AND APPARATUS FOR DELIVERING A PREDETERMINED AMOUNT OF MATERIAL TO A CONTAINER

[75] Inventor: Bernard C. Eisenberg, Rockaway, N.J.

[73] Assignee: Neoax, Inc., Stamford, Conn.

[21] Appl. No.: 820,311

[22] Filed: Jan. 23, 1986

Related U.S. Application Data

[63] Continuation-in-part of Ser. No. 698,810, Feb. 6, 1985, Pat. No. 4,576,209.

[51] Int. Cl.[4] ..... B65B 1/06

[52] U.S. Cl. ..... 141/1; 141/137; 141/311 R

[58] Field of Search ..... 53/276, 467, 564; 141/1, 101, 103, 104, 129, 137, 145, 148, 149, 150, 182, 238, 239, 241, 260, 311 R; 198/533, 540, 543, 549; 221/174, 203, 222, 227, 237; 222/1, 196, 197, 252, 305, 318, 328, 339, 363, 364, 344, 346, 367, 368

[56] References Cited

U.S. PATENT DOCUMENTS

| | | | |
|---|---|---|---|
| 584,891 | 6/1897 | Pierce | 141/137 X |
| 1,770,470 | 7/1930 | Hartmann | 141/145 |
| 2,873,772 | 2/1959 | Prenk | 141/182 X |
| 3,205,920 | 9/1965 | Cozzoli et al. | 141/137 X |
| 3,369,577 | 2/1968 | Johnson et al. | 141/182 X |
| 4,582,103 | 4/1986 | Pieteder | 141/182 X |

FOREIGN PATENT DOCUMENTS

| | | | |
|---|---|---|---|
| 2119866 | 11/1972 | Fed. Rep. of Germany | 141/137 |

*Primary Examiner*—Henry J. Recla
*Assistant Examiner*—Mark J. Thronson
*Attorney, Agent, or Firm*—Kenyon & Kenyon

[57] ABSTRACT

A method and apparatus for delivering a predetermined amount of material into a predetermined position on each of a series of moving trays while avoiding spillage of the product onto other portions of the trays. A conveyor lifts the material onto a shaker pan which delivers the material in an even flow on to a rotating turntable having a plurality of radially extending gutters thereon. The turntable directs the material to flow along the gutters and into a plurality of hoppers disposed at the periphery of the turntable. Once a hopper is full, any excess material falls onto a drip tray which returns the material back to a supply bin. The filled hoppers are sequentially rotated above the trays, which are moving on a conveyor, to release material onto a predetermined area of each successive tray. A funnel disposed between the hopper and the tray facilitates delivery of material onto the tray. The funnel is lowered toward the tray to deliver material, advanced in synchronism with the tray, elevated to clear the tray and material, and then returned to a position adjacent to a hopper.

21 Claims, 13 Drawing Sheets

39
39
76
40
71a
71b
71
69
64
72
73
62
63
64
70
60a
61
64
61
38
46
53
57
61
63
64
66
76
32

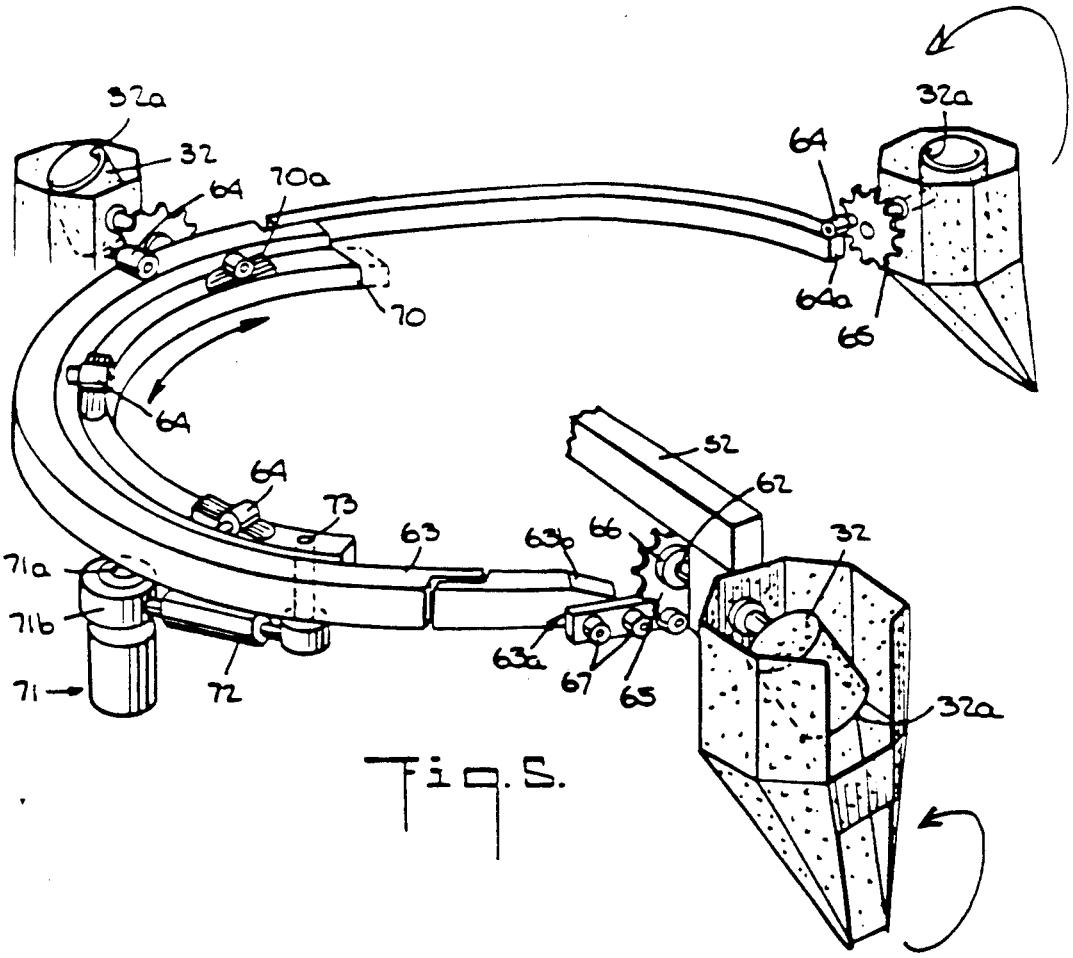
Fig. 5.
Fig. 6.
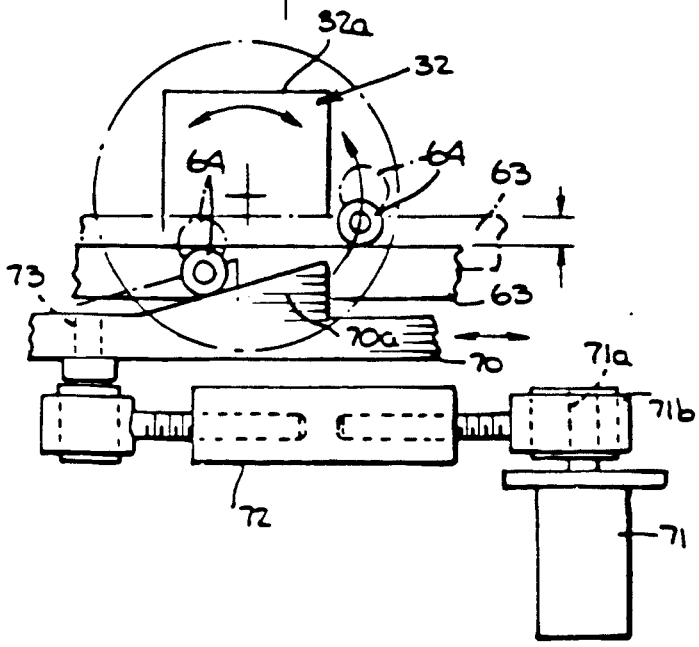
Fig. 7.
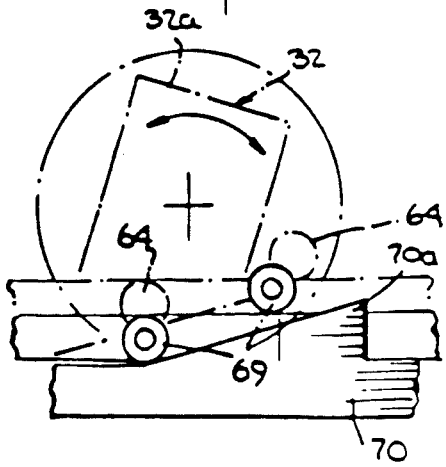

Fig. 8.
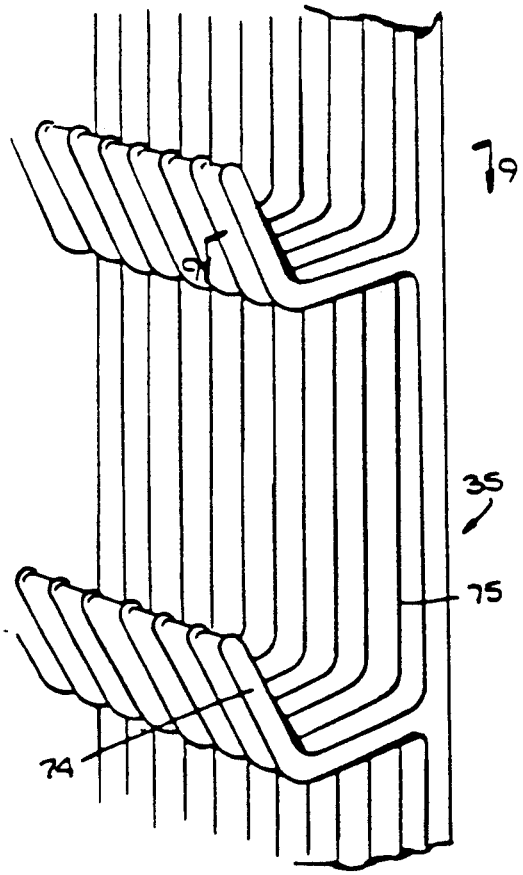
Fig. 9.
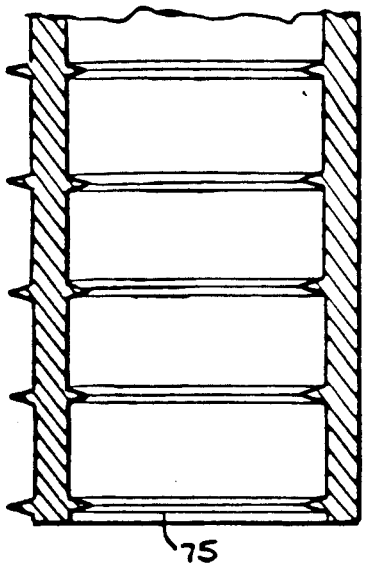
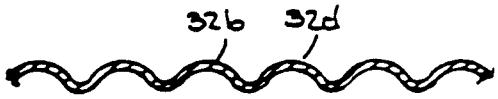
Fig. 10.
Fig. 11.
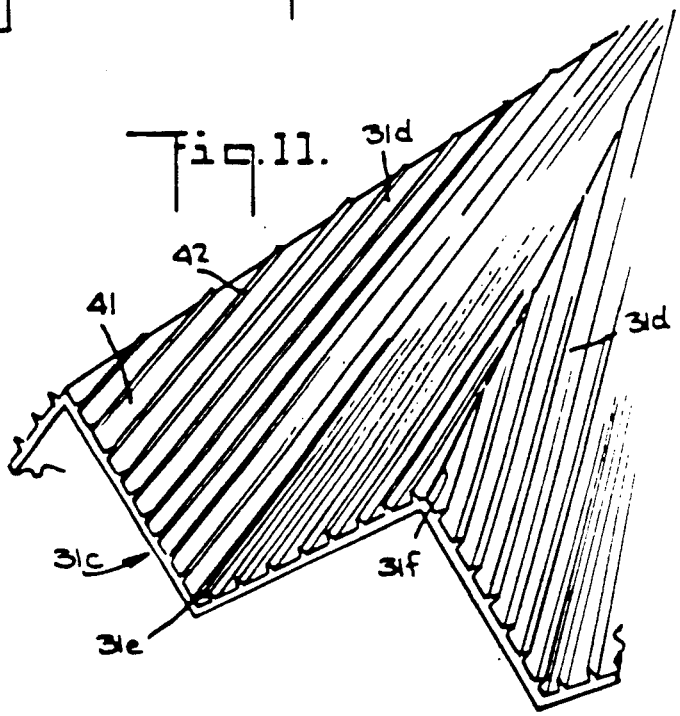
Fig. 12.
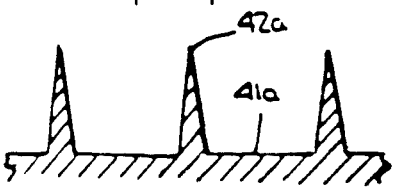
Fig. 13.
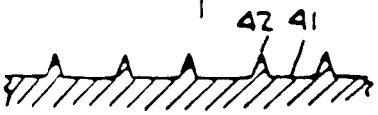

METHOD AND APPARATUS FOR DELIVERING A PREDETERMINED AMOUNT OF MATERIAL TO A CONTAINER

BACKGROUND OF THE INVENTION

1. Field of the Invention

The invention which is a continuation-in-part of application Ser. No. 698,810, filed on Feb. 6, 1985, now U.S. Pat. No. 4,576,209, issued Mar. 18, 1986, relates to a method and apparatus for delivering a predetermined amount of material such as food material to a moving container such as a tray.

The sale of prepared meals for consumption at home goes back in time, at least to the early days of television broadcasting, when the so-called "T.V. dinner" was introduced. The feature of the TV dinner is that it made available a meal which could be stored in frozen form and which could be conveniently heated and served on its own tray for consumption in front of a television set. In more recent times, the desire for prepared meals on trays and typically frozen, is based upon the trend away from the preparation at home of fresh foods for meals. The popularity of frozen meals has also been increased drastically by the growing use of microwave ovens which are the most convenient and rapid way to heat frozen meals. Accordingly, there is a need for equipment within a food processing plant to place predetermined amounts such as predetermined weights of both fresh and cooked food material on trays for subsequent freezing and sealing.

The trays for prepared meals typically contain a plurality of compartments such as a compartment for a meat product, a compartment for a starch product, such as rice or potatoes, and a compartment for a vegetable product. Conventional means are available for delivering a meat product in a predetermined amount to a compartment of a tray since the meat product can be prepared in slices, patties, or the like of fixed weight. Starch materials are conventionally delivered to a tray by a dispensing device which can conveniently handle accurate weights of rice, mash potatoes, and the like. When it comes to a vegetable product to be delivered to a tray, the fibrous or particulate nature of such products in the case of broccoli, cauliflower, stringbeans, etc., makes the delivery or the dispensing of a predetermined amount of material automated by apparatus more difficult. Accordingly, hand selection, weighing and delivering of such vegetable products is typically employed. Where the meat product and the starch product can be delivered by conventional food processing machinery, it becomes evident that the need for hand delivering the vegetable product necessarily complicates and slows down the production of prepared meals on trays.

The method and apparatus of the invention enable a material such as a vegetable food product to be delivered in a predetermined amount to a compartmented tray.

2. Description of the Prior Art

The conventional procedure for delivering food material of a fibrous or particulate nature, such as broccoli, cauliflower, stringbeans and the like to a container has been hand delivery of such food materials. This has been the procedure notwithstanding that the container or tray to which the materials are delivered has been partially filled by machinery for delivering a meat product or a starch product to the tray. The practice has been for a human operator to select, by hand, the amount of vegetable material from a supply and place it on a scale for determining that a predetermined weight of material has been selected. Depending upon the weight indication, additional material is added or excess material is removed from the scale. The human operator then places the weighed food material by hand into the proper compartment on the tray. It is evident that this is a tedious and time-consuming task. Where the trays are being filled by machines with meat products and starch products, it may be necessary to have a plurality of human operators to load the vegetable product by hand at a rate which can match that of the loading of the meat product and the starch product. A consequence of hand loading at a reasonable rate of production of trays is that the control of the predetermined amount of vegetable material, such as by weight, will suffer. Thus, in achieving a reasonable rate of production, the human operator will inevitably overfill or underfill the trays with vegetable material.

SUMMARY OF THE INVENTION

An object of the invention is to deliver a predetermined amount of material such as food material to a predetermined location for release of the material into a container such as a tray used for prepared frozen meals.

Another object of the invention is to provide an apparatus and method for delivering predetermined amounts of fibrous or particulate materials, such as food materials, to a container.

A further object of the invention is to provide a method and apparatus for delivering a predetermined amount of material in which various adjustments can be made in achieving accuracy in the predetermined amount of material to be delivered.

Still another object of the invention is to provide a method and apparatus for delivering predetermined amounts of materials, where the materials are prone to agglomerate or to adhere to any surface with which the material may come in contact.

Still another object of the invention is to provide a method and apparatus for delivering a predetermined amount of material in which the amount of material itself can be conveniently and accurately varied as conditions may require.

These and other objects, features and advantages of the invention will become apparent and more readily appreciated in the following detailed description of a preferred exemplary embodiment of the invention, taken in conjunction with the accompanying drawings.

The invention comprises a method and apparatus for delivering a predetermined amount of material to a predetermined location, such as a location adjacent a container which can be a tray, for example, which is to be filled. The apparatus and method of the invention are particuarly adapted to deliver food material, such as vegetable material, to a tray of the type used for frozen prepared meals.

The apparatus of the invention includes a turntable which is pivotally mounted about a vertical axis with the turntable being crowned and with the periphery of the turntable being lower than the central portion of the turntable Means are provided for depositing a flow of material upon the turntable. The material so delivered is adapted to move radially outwardly and over the periphery of the turntable as the turntable rotates. A plurality of hoppers are disposed, spaced apart from one another, with the mouth of each hopper facing upwardly beneath the periphery of the turntable. The plurality of hoppers are moved in the direction of the rotation of the turntable to enable each of the hoppers to receive material moving radially outwardly over the periphery of the turntable. At a predetermined arcuate extent about the periphery of the turntable in the direction of the rotation of the turntable from the location at which the material is delivered thereto, there is provided means for releasing material from each of the plurality of hoppers. In this way, the hoppers each determine the predetermined amount of material which is ultimately to be released.

The turntable can be provided with a plurality of radially extending gutters, each of which is aligned with a different one of the hoppers in order to direct the flow of material over the periphery of the turntable and into the hoppers.

The hoppers are pivotally mounted with the mouth of the hopper facing upwardly to receive the material and being inverted to face downwardly to release the material. A cam track and cam follower construction can be employed to position each pivotally mounted hopper between a position in which the mouth of the hopper faces upwardly as well as in an inverted position.

To facilitate the movement of material with respect to the turntable, the turntable can be oscillated laterally.

To insure that each hopper is filled with material and that excess material is separated from each hopper, each of the plurality of hoppers can be rocked about their pivotal axis with the amplitude of the rocking being selectable.

The nominal position of each of the plurality of hoppers when the mouth of the hopper is facing upwardly can be selected, again in order to insure that each hopper is filled with material and that any excess material is separated therefrom. Funnels can be disposed adjacent each hopper to direct the flow of material released therefrom to a container or tray.

Any excess material separated from a hopper or otherwise failing to enter a hopper is intercepted by a drip tray which is provided with means for removing such material from the drip tray in response to the motion of the hoppers with respect thereto.

BRIEF DESCRIPTION OF THE DRAWINGS

FIG. 5 is a fragmentary perspective view showing a gear and a gear element for erecting each of the hoppers, a cam track and cam follower for positioning the hoppers, means for vertically reciprocating the cam track to rock the hoppers, and means for vertically positioning the cam track to adjust the upward facing position of the mouth of each hopper;

FIG. 6 is a fragmentary vertical section of the means for vertically positioning the cam track;

FIG. 7 is a fragmentary vertical section showing an alternate position of the vertical adjustment of a cam track;

FIG. 8 is a fragmentary perspective view of the bucket-shaped flights of the product conveyor;

FIG. 9 is an enlarged horizontal section view taken along the line 9—9 in FIG. 8 and showing the ribs on the surface of the product conveyor for minimizing adhesion with the product

FIG. 11 is a fragmentary perspective view of the gutters of the turntable showing the graining thereon to reduce friction with the product;

FIG. 12 is a fragmentary section view of the graining of the gutters of the turntable;

FIG. 13 is a fragmentary section view of the graining of the gutters of the turntable in an alternate configuration;

FIG. 18 is a schematic diagram showing a funnel being lowered toward a tray as a hopper is inverted to deliver material to the funnel and showing the funnel being elevated after having been advanced in synchronism with the tray;

DETAILED DESCRIPTION OF THE PREFERRED EMBODIMENT

The apparatus and method of the invention for delivering a predetermined amount of material to a predetermined location, such as food material into a tray, is described hereinafter in accordance with its preferred embodiment and with reference to the accompanying drawings.

Figure 1:
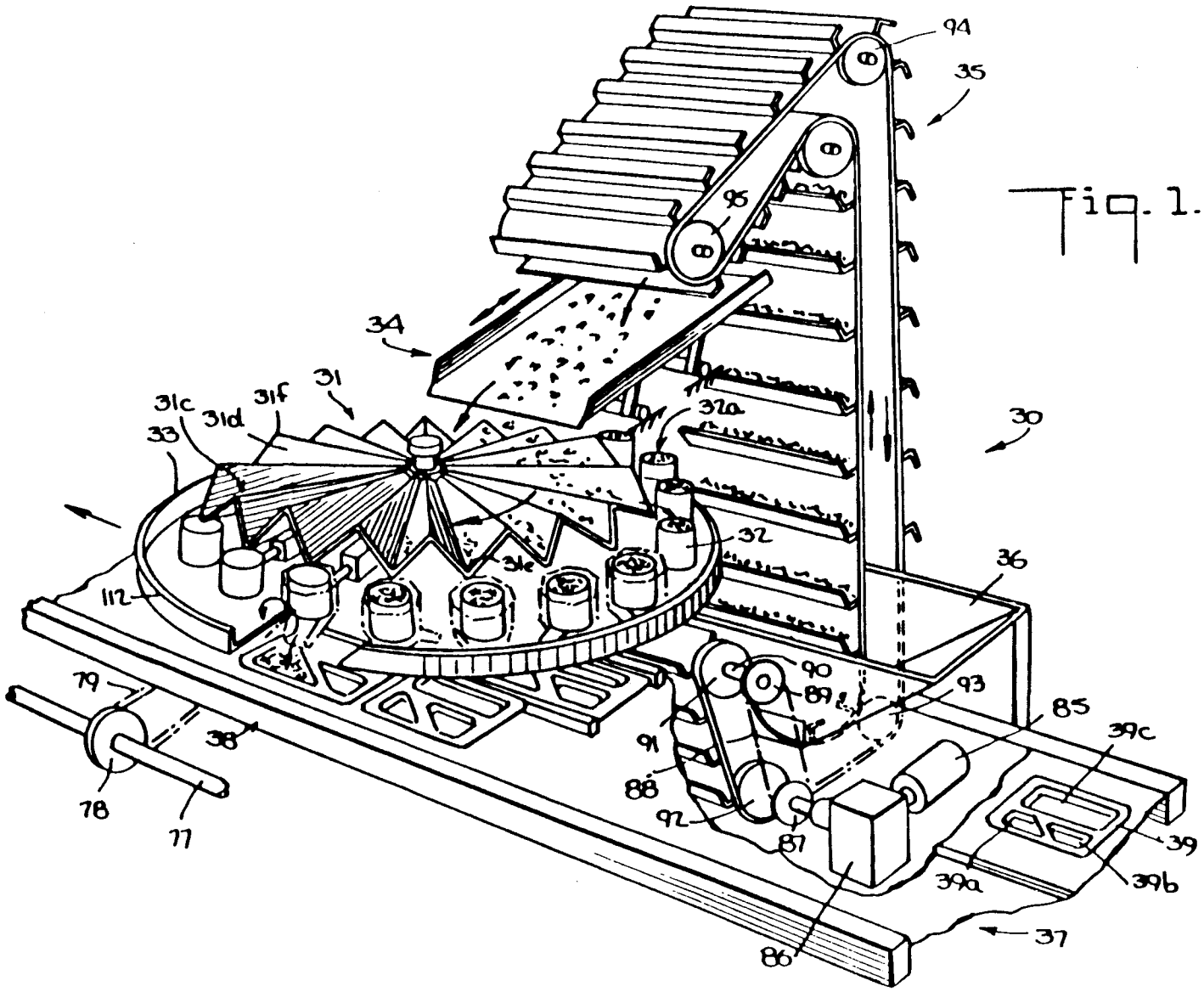
FIG. 1 is a fragmentary perspective view of the apparatus of the invention showing a conveyor for the material to be delivered, a shaker pan, a turntable, a plurality of hoppers, a drip tray and a tray conveyor for advancing trays with respect to the apparatus.

Referring to FIG. 1, the apparatus 30 of the invention includes a turntable 31 which is pivotally mounted about a substantially vertical axis. A plurality of hoppers 32 which are cup-shaped are mounted, spaced apart from one another, with the mouth 32(*a*) of each hopper facing upwardly beneath the periphery of the table. Drip tray 33 is disposed beneath the path of travel of the plurality of hoppers and the periphery of the turntable in order to intercept any material which fails to enter a hopper during the filling operation thereof, or is separated from a hopper during filling. Shaker pan 34 serves as a means for depositing a flow of material upon turntable 31 inwardly of the periphery thereof. Conveyor 35 which operates in the direction of the arrows adjacent thereto as shown in FIG. 1 delivers material from supply bin 36. Tray conveyor 37 advances two rows of trays extending substantially parallel to one another. The trays are advanced beneath the predetermined location 38 of the apparatus where there is disposed the means for releasing material from each of the hoppers 32. Trays 39 each contain, by way of example, three compartments 39(*a*), 39(*b*) and 39(*c*). Further by way of example, a vegetable product can be delivered to compartment 39(*a*), a starch product to compartment 39(*b*), and a meat product to compartment 39(*c*).

Figure 2:
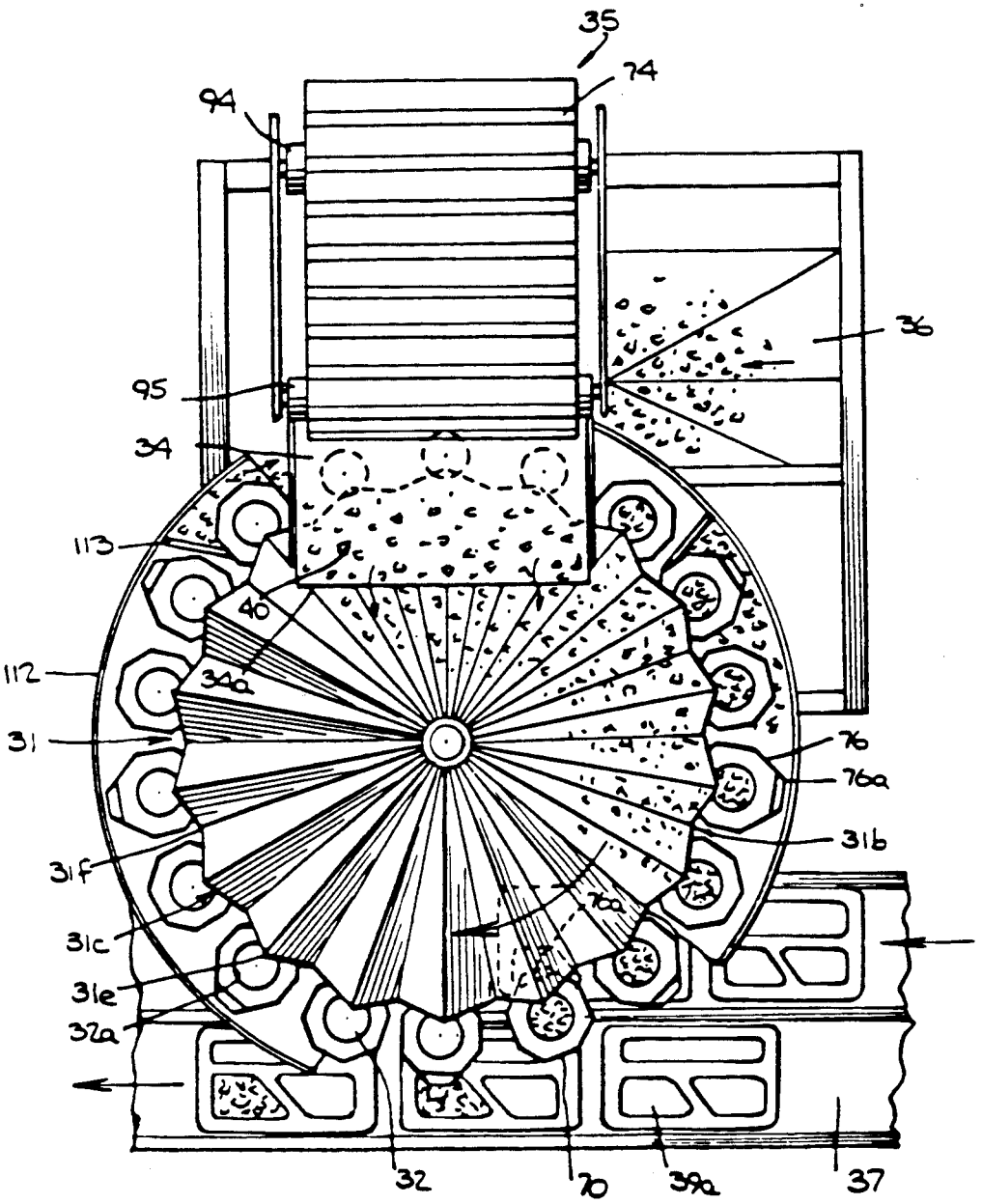
FIG. 2 is a fragmentary plan view of the apparatus of the invention showing the turntable and the plurality of hoppers including the predetermined location for the release of materials to the trays.
Figure 3:
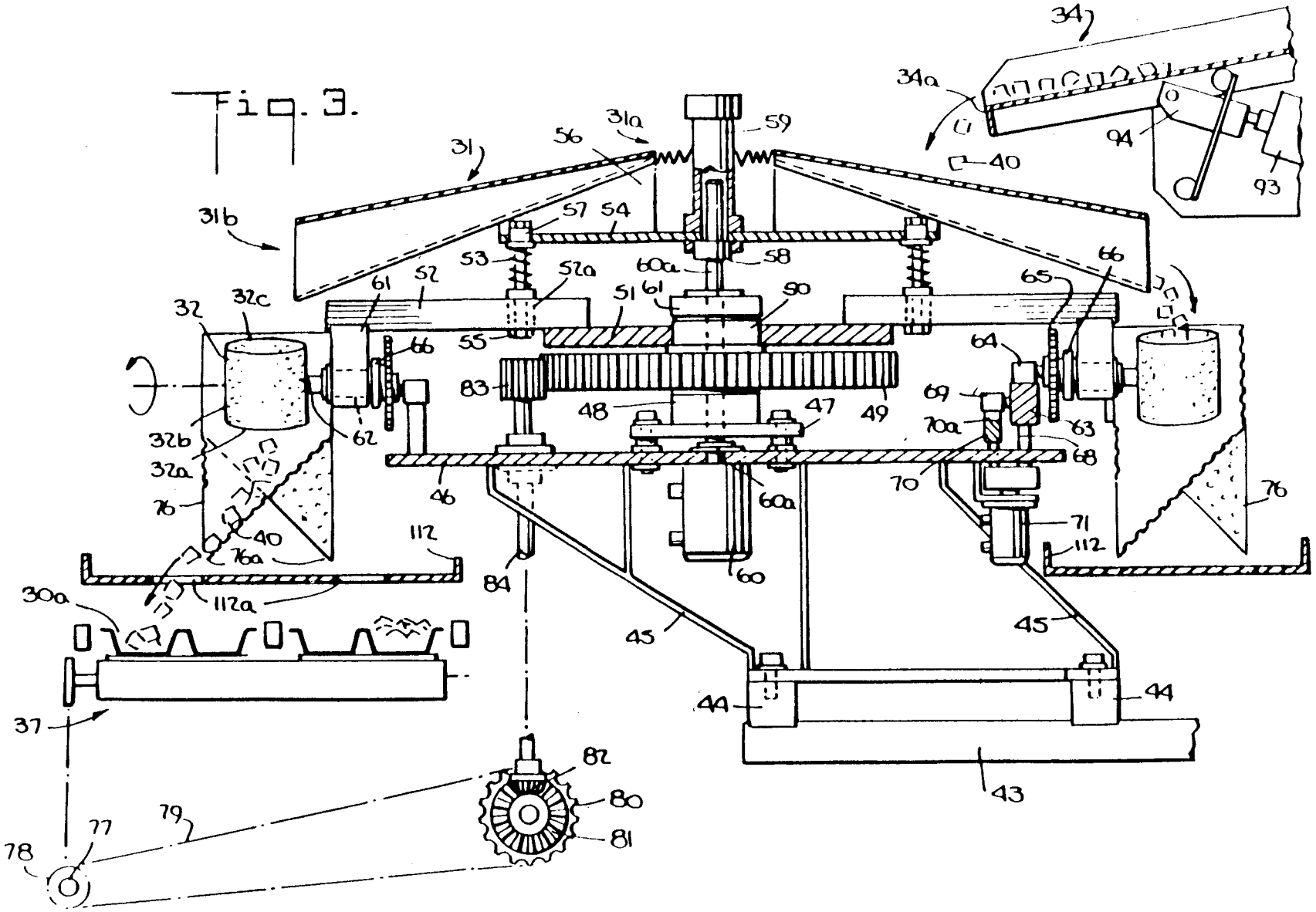
FIG. 3 is a vertical section view showing the drives to the turntable and the plurality of hoppers.

In FIG. 2, there is shown material 40 such as pieces of vegetable material, descending along shaker pan 34 and leaving exit end 34*a* at the lower end of the inclined shaker pan. The material then drops upon the upper portion of turntable 31 radially inwardly from the periphery 31*b* of the turntable. As shown in FIG. 3, the turntable 31 is crowned in the sense that central portion 31*a* thereof is elevated with respect to peripheral portion 31*b* thereof. FIGS. 1 and 3 show that the turntable is provided with a plurality of radially extending gutters 31*c* which are formed by sectors 31*d* sloping with respect to one another and intersecting at bottom portion 31*e* and top portion 31*f*. As shown in FIG. 2, the bottom portion 31*c* of each gutter is aligned with mouth 32*a* of a hopper 32. As the turntable rotates in the direction of the arrow shown in FIG. 2, the material 40 moves radially outwardly within the gutters 31*c* and passes over the periphery 31*a* of the turntable and enters the hoppers 32.

As shown in FIG. 11, the upper surfaces of the sectors forming gutters 31*c* are grained or textured with radially extending grooves 41 disposed between ridges 42. FIG. 13 shows ridges 42 which can be substantially triangular in profile and can be formed from a sheet of elastomer or resin material which is attached to the sectors 31*d* of the turntable. In the alternative, higher ridges 42*a* with wider grooves 41*a* can be used as determined by the nature of the material 40. It can be seen in FIG. 11 that the grooves and ridges extend radially, that is substantially parallel to the bottom portion 31*e* of each of gutters 31*c*. By extending radially, material 40 can move radially outwardly with respect to the gutters with the least tendency to adhere thereto.

The means for rotating turntable 31 about its vertical axis is shown in FIG. 3. Frame member 43 to which is attached frame elements 44 supports uprights 45. In turn, the uprights support base plate 46. Adapter 47 is mounted on base plate 46 and supports bearing 48 which rotatably supports gear 49. The gear is coupled through hub 50 to plate 51.

Figure 4:
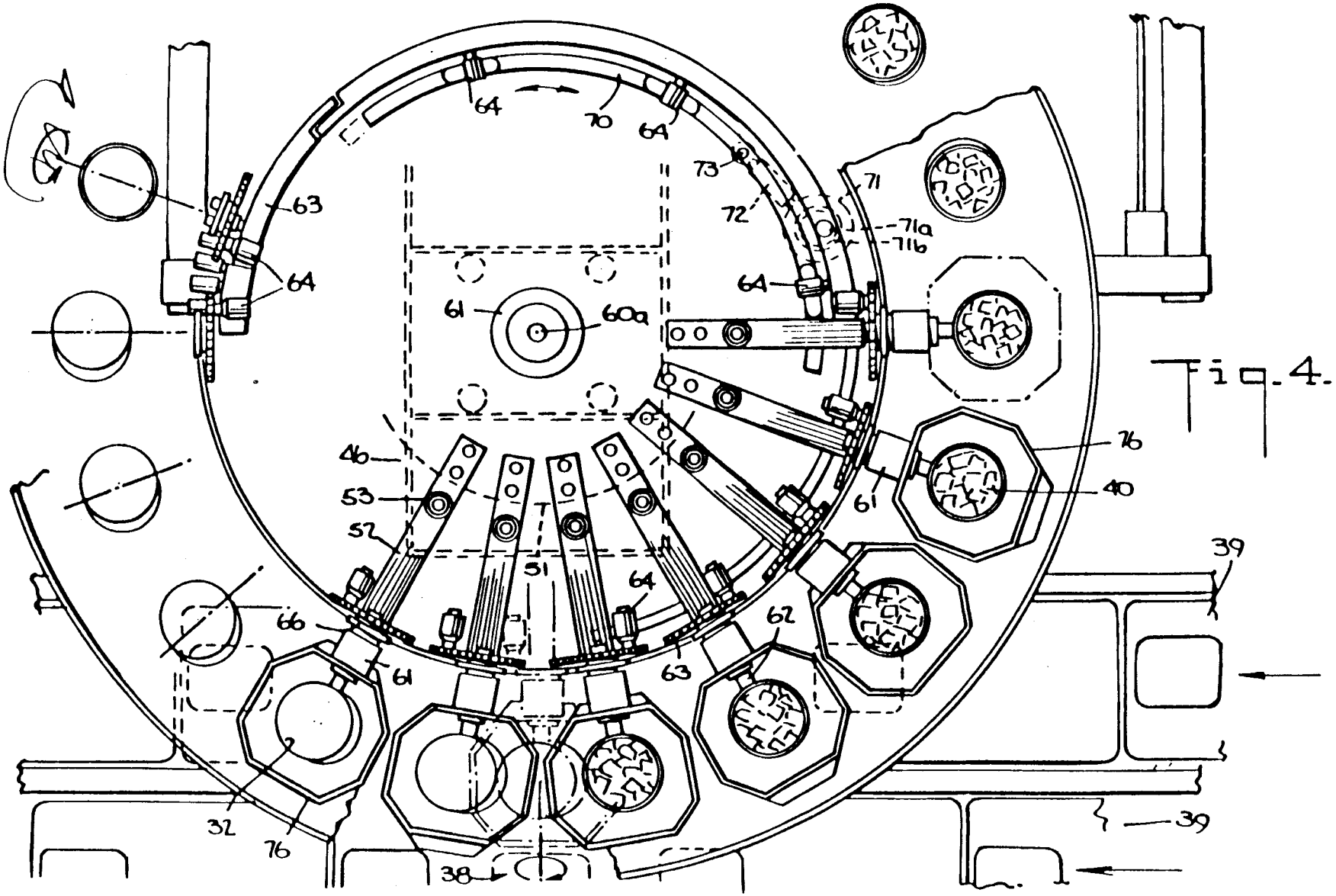
FIG. 4 is a fragmentary plan view of the plurality of hoppers, the funnels for the hoppers, and the means for pivotally mounting each of the hoppers.

In FIGS. 3 and 4, radially extending spokes 52 are shown mounted upon plate 51. The spokes 52 support springs 53 which in turn support carrier 54 engaged with the spokes by screws 55. Ribs 56 attach turntable 31 to carrier 54. Clearance is provided in the openings 52*a* within spokes 52 in order that screws 55 can move laterally to a limited extent with respect to the spokes. Washers 57 have clearance with respect to screws 55 in order that the screws have freedom with respect thereto. With this arrangement, it can be understood that the carrier and thereby the turntable has a resilient suspension which enables the turntable to move somewhat vertically as well as to an extent horizontally.

The means for oscillating the turntable laterally with respect to its vertical axis includes eccentric 58 which is attached to hub 59 of the central portion of the turntable. Motor 60, which by way of example can be a hydraulic motor, has a shaft 60*a* which is coupled to eccentric 58. The shaft is piloted by bearing 61 mounted on hub 50. Rotation of shaft 60*a* causes carrier 54 to oscillate in a lateral direction and thereby oscillates the turntable in a lateral direction with respect to its vertical axis.

FIG. 3 shows the means for pivotally supporting each of the plurality of hoppers 32. A support 61 is attached to each of spokes 52. A shaft 62 attached to the hopper 32 pivotally mounts the hopper with respect to support 61. As shown in FIG. 5, the means coupled to each shaft 62 for maintaining the shaft in a position in which the mouth 32*a* of a hopper 32 is facing upwardly includes cam track 63 and cam follower 64. The cam follower which can be a roller cam follower is mounted on gear or sprocket 65 which in turn is connected to shaft 62. In FIG. 5 it can be seen that whenever cam follower 64 is in rolling engagement with cam track 63, the sprocket and thereby the shaft 62 and hopper 32 connected thereto are rotated to a position in which the mouth 32*a* of the hopper faces substantially upwardly.

Each of the hoppers 32 is provided with means for biasing the hopper to an inverted position. As shown in FIG. 3, the biasing means comprises clock spring 66 having one end portion connected to support 61 and the opposite end portion connected to shaft 62. A bucket 32 is shown in an inverted position in FIG. 5 in response to the biasing of clock spring 66.

In FIG. 5, there is shown means for erecting each hopper into a position in which the mouth of the hopper faces upwardly. The erecting means includes the engagement of gear or sprocket 65 with gear element 67 which can comprise a plurality of spaced cogs. Thus as is seen in FIG. 5, the rolling motion of sprocket 65 with respect to cogs 67 rotates the sprocket in a counterclockwise direction and thereby shaft 62 which is connected to hopper 32. Once the sprocket has approached end portion 63*a* of cam track 63, cam follower 64 is rotated by the engagement of sprocket 65 with cogs 67 with the result that the follower is then placed in engagement with the upper surface of cam track 63. The engagement of the follower with the cam track prevents the hopper from being driven into its inverted position by spring 66.

As seen in FIG. 5, hopper 32 remains in an upwardly facing position in response to the engagement of the cam follower with the cam track until end portion 64*a* of the cam track is reached. Here the cam follower 64 leaves the cam track and in response to the biasing of the shaft 62 by clock spring 66, the hopper is inverted. In FIG. 3, there is shown vertically sliding support 68 for laterally positioning cam track 63 with respect to base plate 46. As shown in FIG. 5, cam track 63 is provided with a plurality of rollers 69 which extend radially inwardly from the inner wall of the cam track. Adjacent to the inner wall of the cam track is carrier 70 which contains ramps 70*a* which are in rolling engagement with roller 69. Circumferential movement of carrier 70 as shown by the arrow in FIG. 5, moves the ramp with respect to the roller and thereby changes the vertical position of cam track 63 from a minimum position at the lower end of the ramp to a maximum elevated position at the high end of the ramp (See FIGS. 6 and 7). It can be understood that movement of the cam track vertically provides a means for rocking the hoppers by engagement of the cam followers 64 with the cam track. The carrier is moved in a reciprocating circumferential manner as indicated by the dotted lines in FIG. 5 by means of an actuator, for example a hydraulic motor 71. Shaft 71*a* of the motor rotates eccentric 71*b* which is coupled by turnbuckle 72 to pin 73. The pin 73 is pivotally engaged with the carrier 70. The rotary motion of the shaft 71*a* of motor 71 is converted into reciprocating motion by eccentric 71*b*. Thus, it can be seen that upon driving actuator 71, the carrier 70 can be reciprocated circumferentially with respect to the cam track, thereby reciprocating the ramps 70*a* with respect to rollers 69. By way of example, shaft 71*a* of motor 71 can be driven at approximately 300 RPM. This rotational speed results in a rocking motion of about 300 cycles per minute for the hoppers.

The adjustment of turnbuckle 72 enables the nominal vertical position of the cam track to be established at a predetermined level with respect to which the cam track is vertically oscillated. The nominal vertical position of the cam track as determined by turnbuckle 72 sets the position of the cam follower 64 during its travel with respect to the cam track and thereby the angular position of the upwardly facing hopper during the filling operation (FIGS. 6 and 7). Thus, the hopper can be selectively tilted from a nominal horizontal position of the mouth 32*a* of the hopper (FIG. 6) to a nominal tilted position of the hopper 32 (FIG. 7) in order to receive a predetermined amount of material within the hopper during the filling cycle. The angle of tilt of the hopper 32 determines the volume of the hopper which is available for filling and thereby the amount of material being received by the hopper In FIGS. 6 and 7, the setting of the position of bucket 32 is shown In FIG. 6, the mouth 32*a* of the bucket is shown facing vertically and extending in a substantially horizontal position. Alternate vertical positions of roller follower 64 are shown for alternate vertical positions of cam track 63 as determined by ramps 70*a* and roller 69. In FIG. 7, the mouth of bucket 32 is shown in a tilted position. In FIGS. 6 and 7, the interaction of rollers 69 and ramps 70*a* show the range of adjustments which can be achieved. In summary, the means for rocking each of the plurality of hoppers about their laterally extending axes of rotation comprises the driving of eccentric 71*b* by actuator 71 to introduce a vibratory motion through the turnbuckle and pin 73 to carrier 70. The vibratory motion is transmitted by ramps 70*a* to rollers 69 and thereby to cam track 63. By adjusting the rotational speed of shaft 71*a* of actuator 71, the frequency of the vibratory motion is selected.

In FIG. 8, there is shown bucket-shaped flights 74 for delivering material to shaker pan 34. The surfaces of the conveyor 35 including flights 74 which contact the product being delivered to the turntable are grained or textured as shown in FIG. 9 with ribs 75 which prevent the material from adhering to the surfaces during operation of the product into compartment 39*c*.

Figure 10:
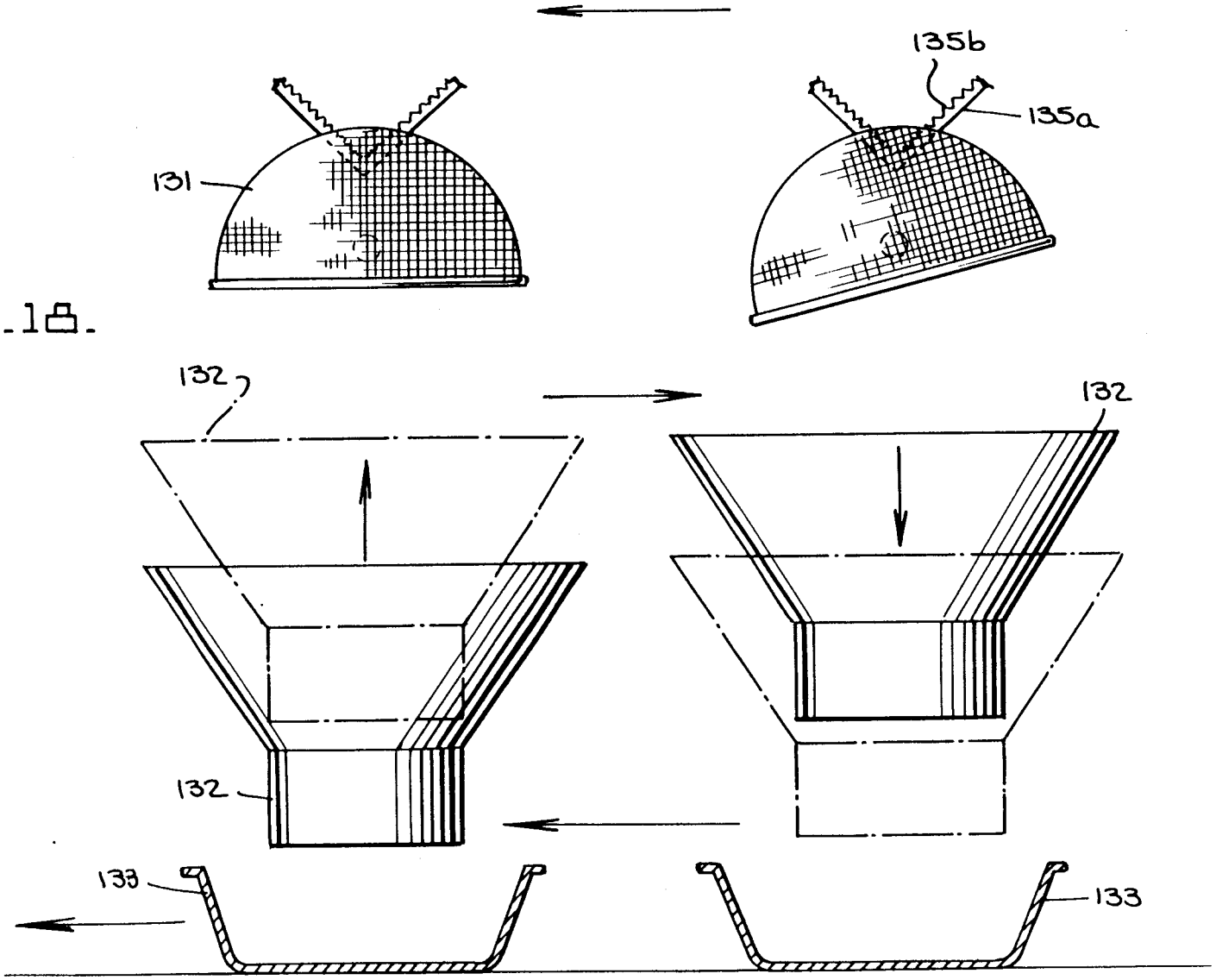
FIG. 10 is a fragmentary section view of a hopper showing a ribbed surface for the hopper.
Figure 19:
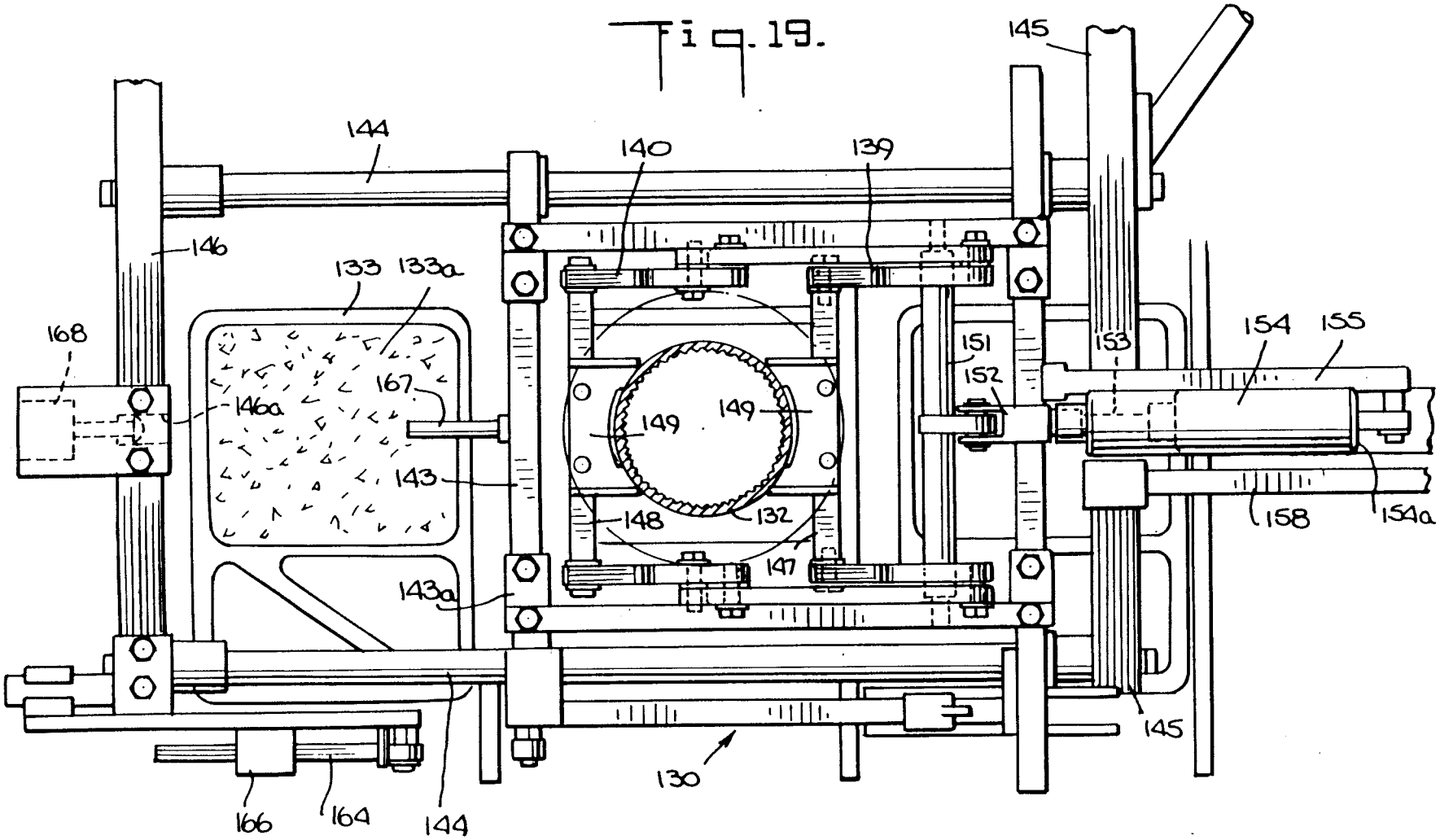
FIG. 19 is a fragmentary plan view of the mechanism for lowering and raising the funnel and for advancing the funnel in synchronism with the tray.

In FIG. 10, there is shown a section of a wall or bottom 32*b* and 32*c* of hopper 32 which is provided with a raised or stippled surface 32*d* for preventing the adhering of the material to the interior of the hopper upon the releasing of material 40 from hopper 32 is shown in FIG. 3.

Funnels 76 mounted upon supports 61 direct the product being released from the hoppers into the proper compartment of the tray. As shown in FIGS. 2 and 3, the lower end portion 76*a* of each of the funnels alternate in circumferential position in order that the hoppers may fill trays in each of the two parallel rows of trays. In order to present compartments 39*a* of the pair of rows of trays to the successive hoppers, the rows of trays are staggered on conveyor 37 with respect to one another as shown in FIG. 1.

In FIG. 1, there is shown shaft 77 having sprocket 78 and chain 79. Shaft 77 is driven in synchronism with the drive for conveyor 37. In FIG. 3, there is shown chain 79 engaged with sprocket 80 having bevel gear 81 which is meshed with bevel pinion 82. Bevel pinion 82 drives pinion 83 by means of shaft 84. Since pinion 83 is meshed with gear 49, the drive for turntable 31 rotates in synchronism with the conveyor 37.

In FIG. 1, there is shown the drives for the conveyor 35 which include motor 85, which by way of example can be a hydraulic motor, having a controllable speed, and angle gear drive 86. The gear drive is coupled to sprocket 87 which in turn is coupled by chain 88 to sprocket 89 mounted on shaft 90. Shaft 90 drives pulley 91 which is engaged with conveyor 35. The conveyor passes over rollers 92–95. The control of the speed of hydraulic motor 85 enables the rate of delivery of material from supply bin 36 to be adjusted to match the rate of filling of hoppers 32.

Shaker pan 34 which receives material 40 from conveyor 35 can be vibrated by actuator 93, coupled to the shaker pan by link 94. Accordingly, the shaking motion of the shaker pan can be tuned by means of actuator 93 to deliver a steady flow of material 40 to turntable 31.

Figure 14:
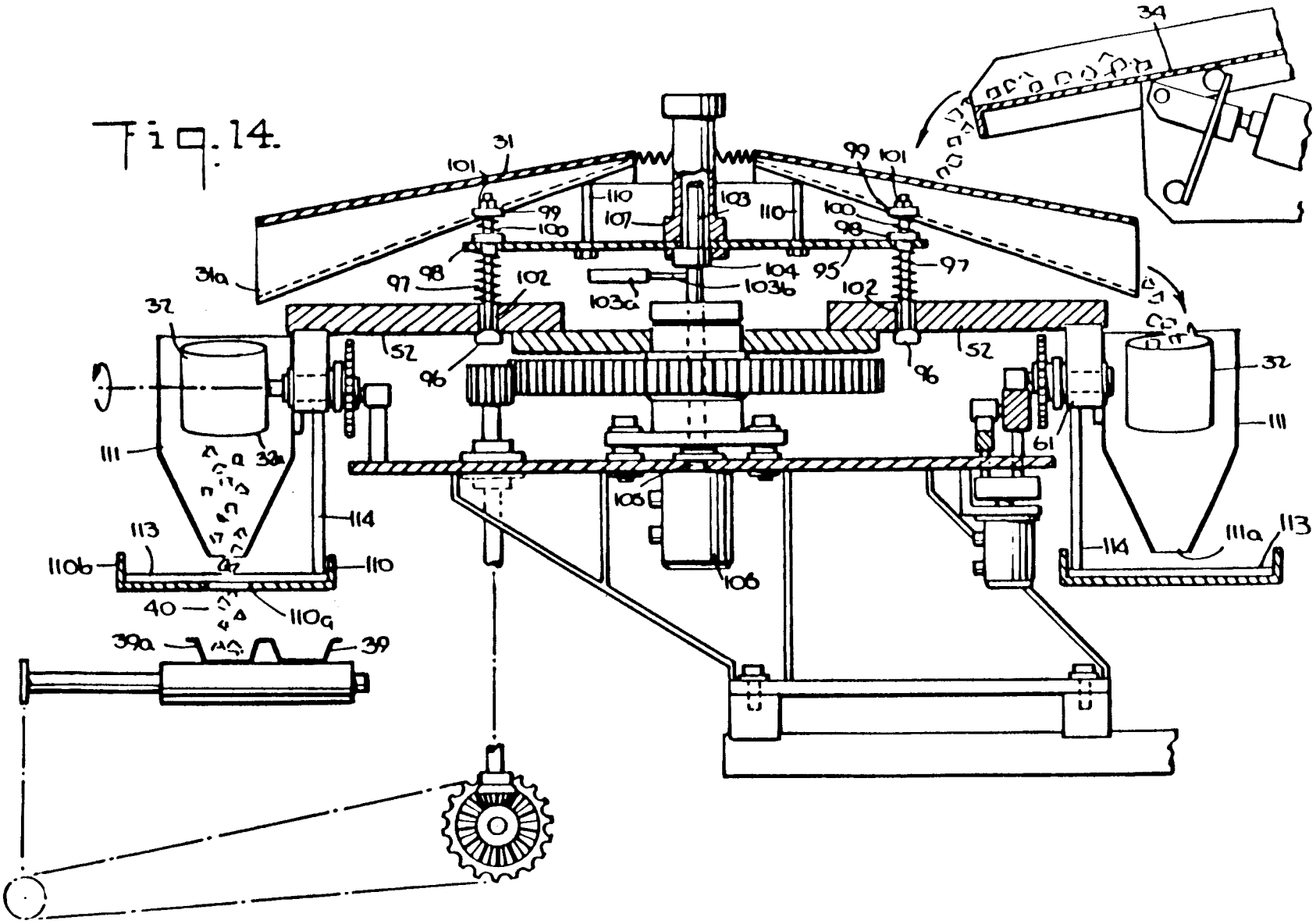
FIG. 14 is a vertical section view showing another embodiment of the suspension of the turntable.
Figure 16:
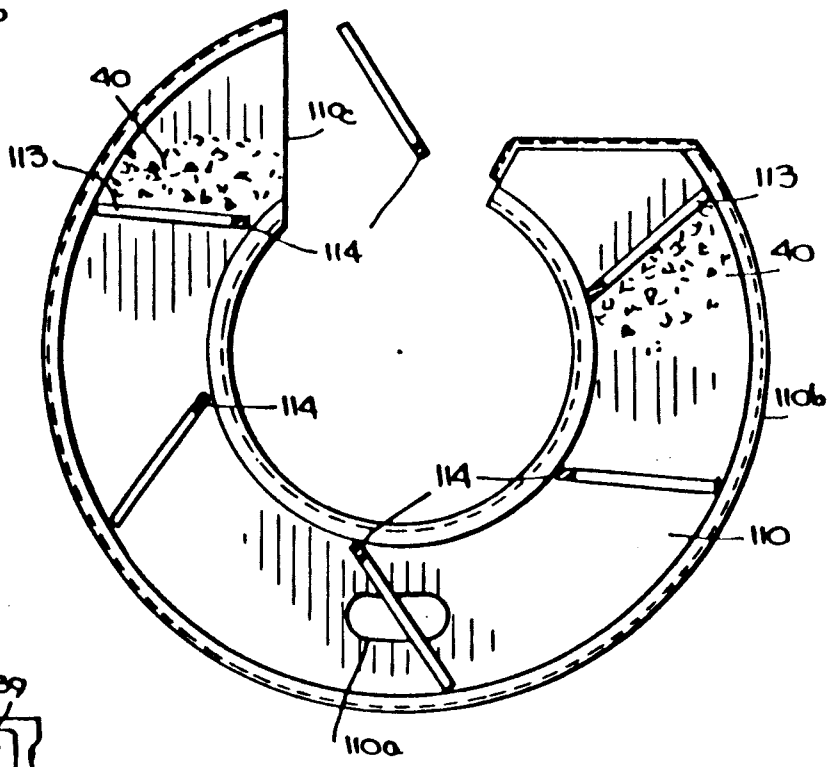
FIG. 16 is a plan view of the drip pan and wipers.

In FIG. 14, there is shown another embodiment of the invention in which carrier 95 for turntable 31 is supported by bolts 96 about each of which is disposed spring 97 which engages the bottom surface of the carrier. Above the carrier, retainers 98 and 99 between which is mounted spring 100, resiliently support the carrier and thereby the turntable for vertical and horizontal movement. Nut 101 secures retainer 99 with respect to bolt 96. Sockets 102 adjacent to the head of bolt 96 enable the bolt to rock with respect to carrier 52.

Shaft 103 which is coupled to eccentric 104 is slidingly engaged by a coupling (not shown) to shaft 105 of motor 106. Uprights 110 support turntable 31 with respect to carrier 95. Eccentric 104 is coupled to sleeve 107 which oscillates turntable 31 horizontally. Due to the suspension of turntable 31 by springs 97 and 100, the horizontal oscillation of the turntable causes some vertical vibratory movement of the turntable. By way of example, motor 106 can drive shaft 103 having eccentric 104 at approximately 500 RPM. To eliminate any unbalance due to the mass of the turntable 31 during oscillation, counterweight 103*a* may be mounted on shaft 103 by support 103*b*, opposite to the portion of eccentric 104 which is furthest from the centerline of the shaft 103. Counterweight 103*a* is adjustably mounted on support 103*b* in order to achieve balance.

Figure 15:
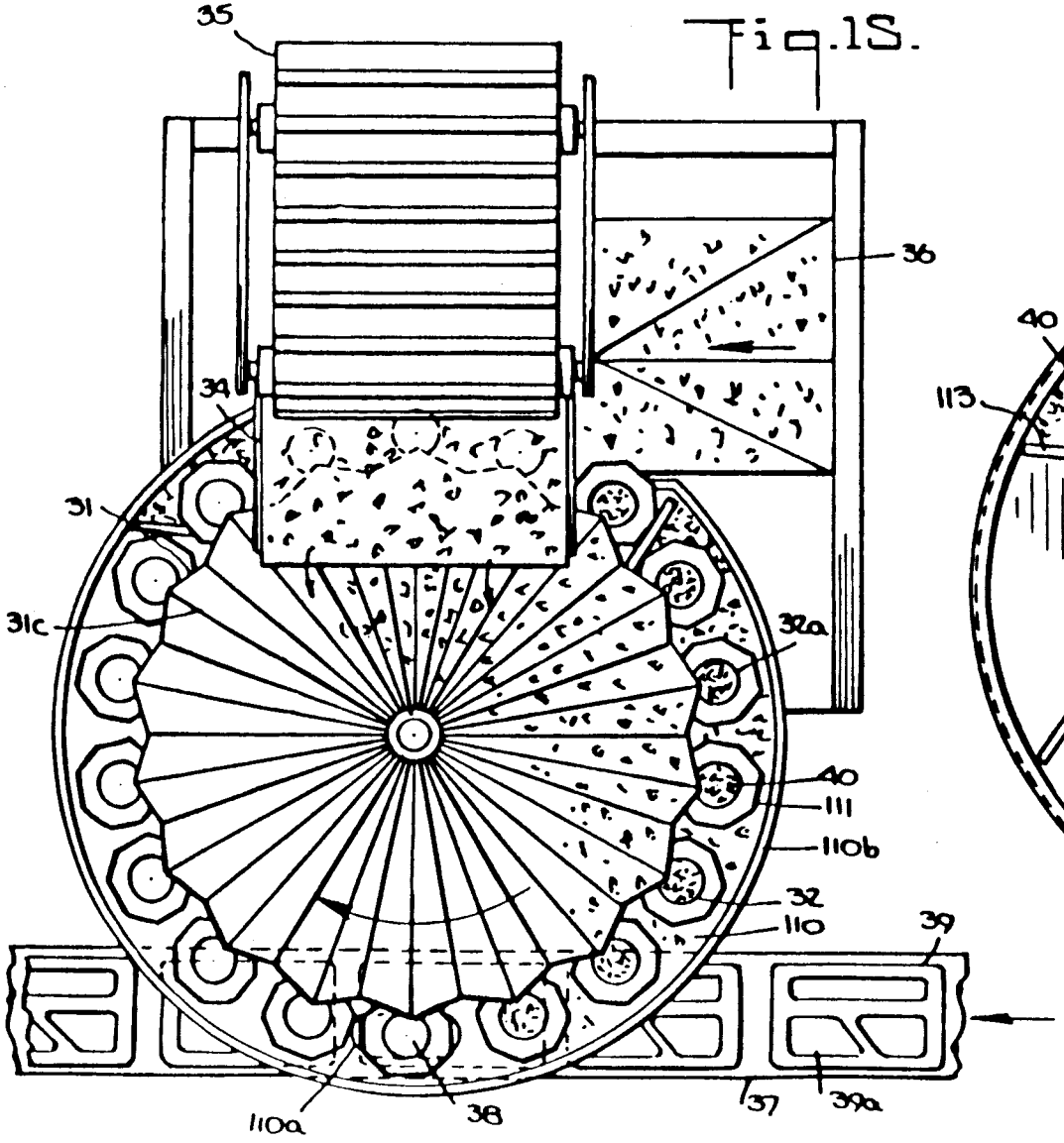
FIG. 15 is a plan view showing the apparatus adapted to deliver material to a single row of trays and showing a drip pan with wipers beneath the hoppers.

In FIGS. 14 and 15, there is shown drip pan 110 which is disposed beneath the path of travel of hoppers 32. In the embodiment of FIGS. 14 and 15, the hoppers are provided with funnels 111 which have a centrally disposed spout 111*a* to deliver material to a single row of trays. By way of example, the single row of trays can be advanced by the conveyor at approximately 200 trays per minute. Where turntable 31 has eighteen hoppers, by way of example, as shown in FIG. 14, the turntable and hoppers are rotated at approximately 11.1 RPM to be in synchronism with the arrival of the trays. Adjacent the releasing location 38 where the material is released from the inverted hopper 32 (FIG. 15), drip pan 110 is provided with opening 110*a* as shown in FIG.

16. In this way, material 40 can pass through opening 110*a* and enter compartment 39*a* of tray 39. In the case of a drip pan 112 for the embodiment of the invention shown in FIGS. 1–3, the drip pan is provided with a pair of openings 112*a* for sequentially delivering material 40 into the trays of each of the staggered pair of rows of trays.

In FIG. 15, it is shown that as material 40 is delivered by turntable 31 to hoppers 32, a certain amount of the material can fall between the hopper and funnel 111 or even outside of the funnels and thereby land upon drip pan 110. To prevent an accumulation of material 40 on drip pan 110 during operation, there are provided wipers 113 which are angled with respect to the periphery of the drip pan as shown in FIG. 15. Accordingly, the wipers when driven in rotation with respect to the drip pan can advance any material 40 on the drip pan to adjacent the periphery 110*b* of the drip pan.

In FIG. 14, wipers 113 are shown as mounted by arms 114, attached to supports 61. Accordingly, the wipers 113 are driven in rotation by the spokes 52 to which supports 61 are attached. FIG. 15 shows that at exit portion 110*c* of drip pan 110, material 40 is urged by wiper 113 to move in the direction of the arrow and return to supply bin 36.

Figure 17:
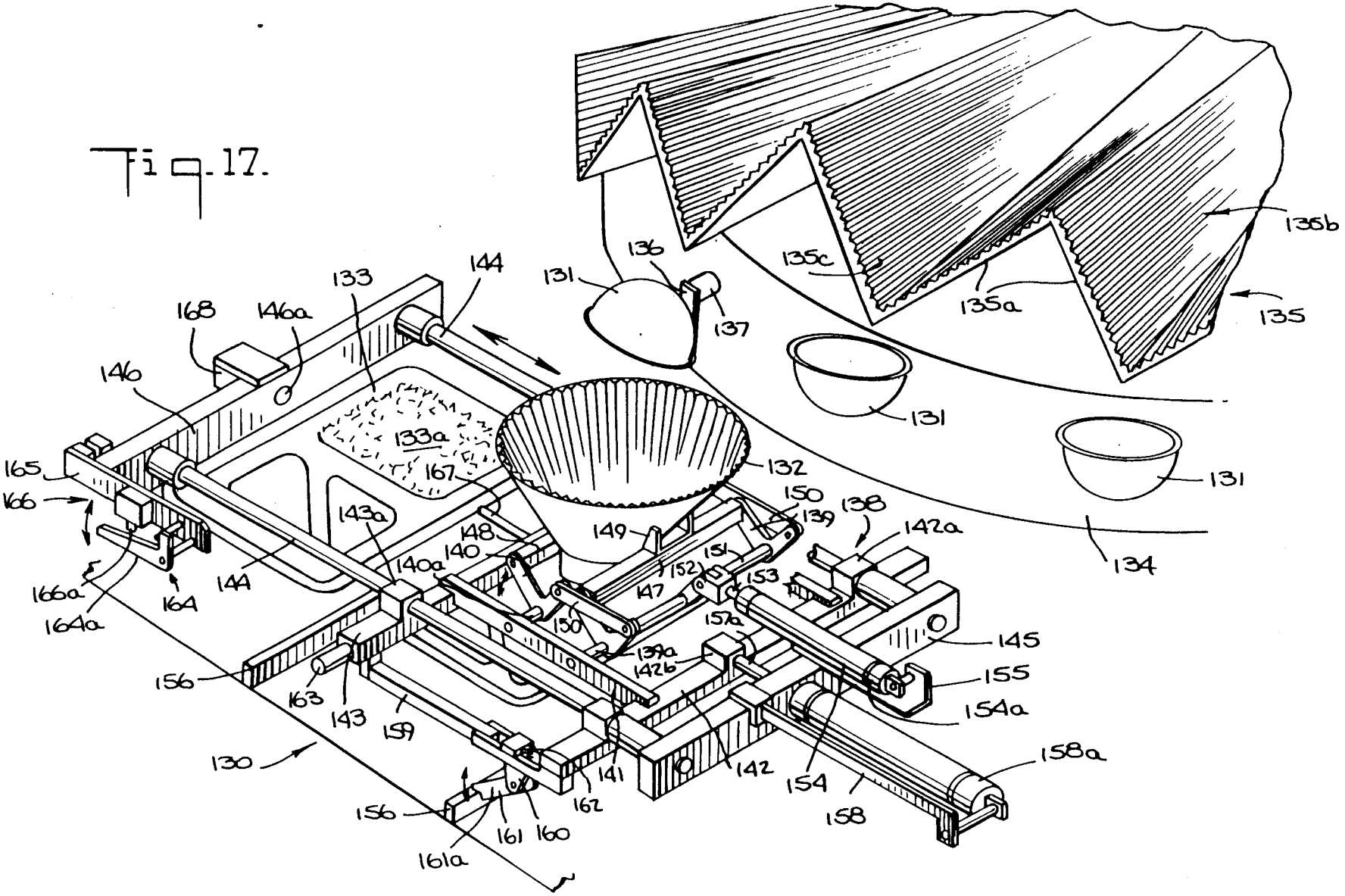
FIG. 17 is a fragmentary perspective view of a funnel for transferring material from a hopper onto a tray and a mechanism for advancing the funnel in alignment with the moving tray.

In FIG. 17, there is shown apparatus 130 for delivering material from cup 131 by means of funnel 132 into a compartment of tray 133. Thus, apparatus 130 comprises another embodiment of apparatus 30 of the invention. It is desired that the cups 131 which are pivotally mounted with respect to support 134 and which receive material from turntable 135 be capable of delivering all of the material within a given cup to a compartment 133*a* of the tray rapidly and without spillage. Apparatus 130 accomplishes this desired function by lowering funnel 132 to adjacent the compartment 133*a* of the tray and then advancing the funnel in the direction of travel of the tray as the material within the funnel is deposited within the compartment. Subsequently, apparatus 130 elevates the funnel and reciprocates the funnel back to a starting position at which the funnel is ready to receive material from the next cup 131. The cups 131 are rotated from an upright position for receiving material to an inverted position for releasing the material into funnel 132 by a mechanism such, for example, as that shown for apparatus 30 for rotating hoppers 32. Each cup 131 is supported by arm 136 extending from rotatable shaft 137.

In FIG. 18, there is shown schematically the desired motion for funnel 132 during the cycle in which the funnel receives material from cup 131 and is lowered toward tray 133. FIG. 18 further shows the funnel when in the lower position shown by dash lines being moved to the left as viewed in FIG. 18 and shown by an arrow adjacent trays 133. During this movement, the material descends from funnel 132 into tray 133. At the end of the movement of funnel 132 to the left as viewed in FIG. 18, the funnel is elevated and thereby made ready for movement to the right as shown in FIG. 18 to place the funnel beneath the next cup 131 to commence the next cycle of movement of funnel 132. Subsequent to the location at which the funnel 132 is elevated, cup 131 is rotated in a counterclockwise direction to return the cup to its upright position for delivery of material thereinto.

As shown in FIG. 17, gutters 135*a* of turntable 135 may be provided with a grained or textured surface such as that having grooves 135*c*.

Figure 20:
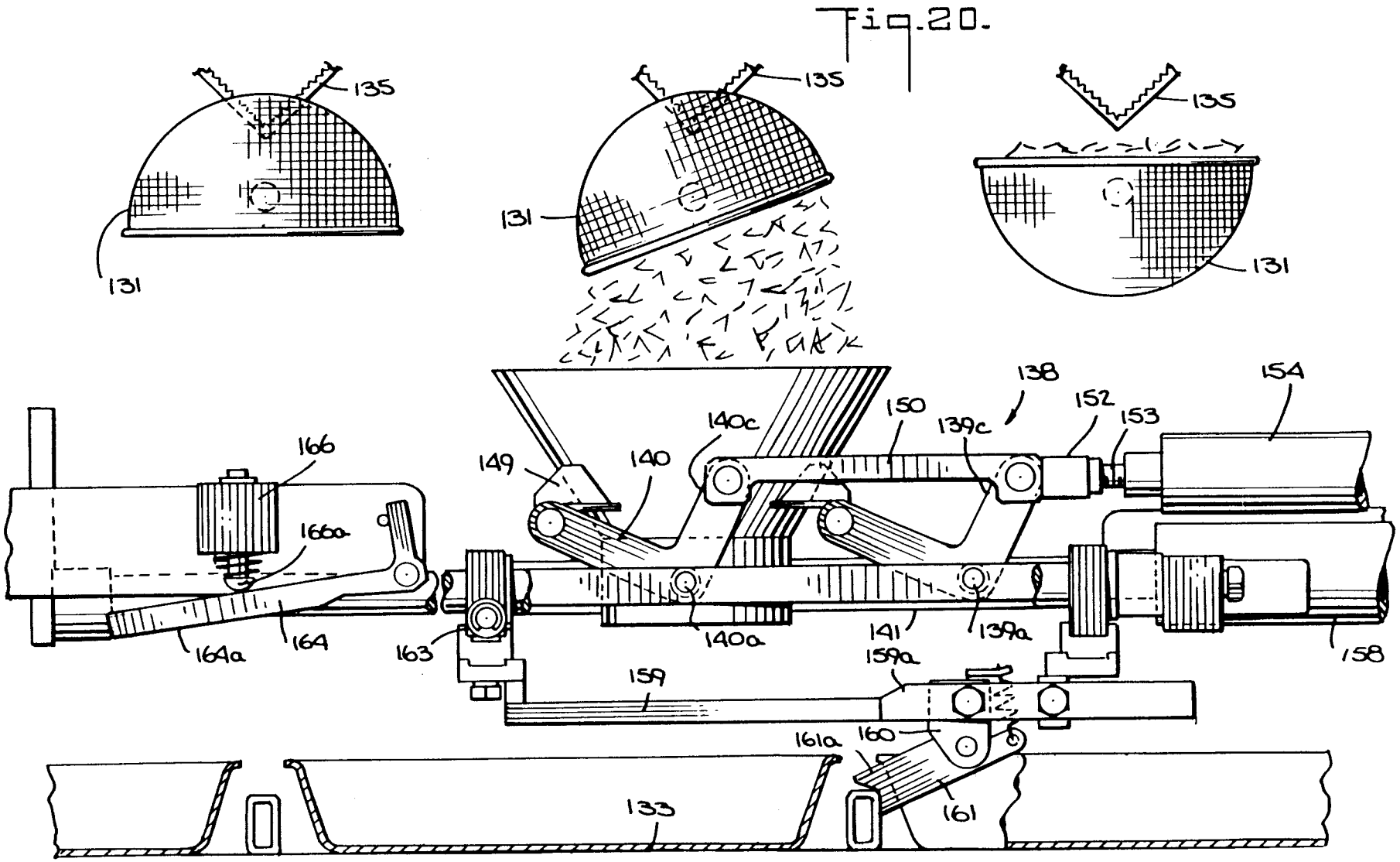
FIG. 20 is a fragmentary elevation view showing a funnel in the upward position prior to being lowered and advanced in synchronism with the tray.

In FIG. 20, there is shown mechanism 138 for reciprocating funnel 132 with respect to tray 133. As shown in FIG. 17, mechanism 138 includes pairs of bellcranks 139 and 140 which are pivotally mounted with respect to shafts 139*a* and 140*a*. In turn, the shafts are mounted within supports 141 mounted upon carriers 142 and 143. The carriers are slidably mounted with respect to support rods 144 by blocks 142*a* and 143*a* in slidable engagement with the support rods. The support rods are mounted with respect to frame members 145 and 146.

Pins 139*b* and 140*b* of the bellcranks are pivotally connected to bars 147 and 148 respectively. Brackets 149 mount funnel 132 with respect to bars 147 and 148. Ends 139*c* and 140*c* of the bellcranks are pivotally coupled to one another by links 150. In addition, links 150 are pivotally connected to shaft 151 having bracket 151*a* pivotally connected to yoke 152. The yoke is attached to piston rod 153 of actuator 154 which can be either hydraulic or pneumatic. End 154*a* of the actuator is pivotally mounted with respect to bracket 155 which is mounted upon frame member 145.

Figure 21:
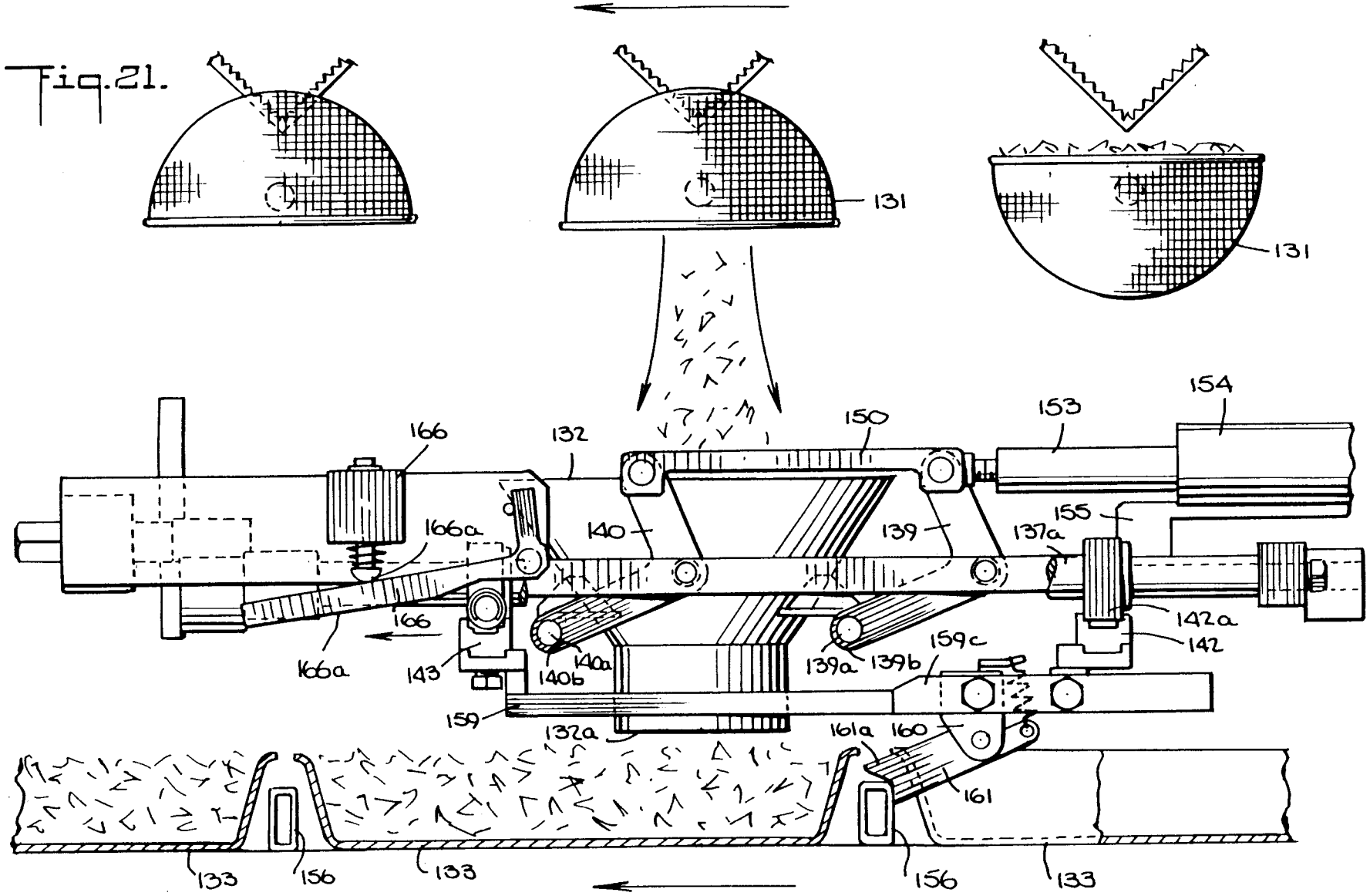
FIG. 21 is a fragmentary elevation view showing the funnel lowered for delivery of material into the tray with the funnel being advanced in synchronism with the movement of the tray.

With actuator 154 in its retracted position as shown in FIG. 20, piston rod 153 is moved to the right as shown in the drawing. As a result the bellcranks 139 and 140 by means of link 150 are in their full clockwise position as viewed in the drawing. In this position, tubular element or funnel 132 is in an elevated position, ready to receive material from cup 131. When piston rod 153 is advanced from its retracted position as shown in FIG. 21, link 150 is moved to the left as viewed in the drawing with the result that bellcranks 139 and 140 are rotated in a counterclockwise direction. Funnel 132 is thereby moved downwardly toward tray 133. As seen in FIG. 21, material is emptied downwardly from inverted cup 131 into the opening of the funnel.

To facilitate delivery of material into funnel 132 and to prevent spillage of the material as it enters tray 133, it is desired to advance the funnel in synchronism with the motion of the tray by means of a conveyor having flights 156. As shown in FIG. 17, actuator 158 is mounted with respect to frame member 145 by bracket 157 which is pivotally connected to the actuator at end portion 158*a* thereof. The actuator can be either hydraulic of pneumatic. Piston rod 157*a* of the actuator extends freely with respect to frame member 145 and is connected to upright 142*b* of carrier 142. In this way, movement of piston rod 157*a* is transmitted to carrier 142 an by means of supports 141, to carrier 143. Since funnel 132 is supported by means of the bellcranks with respect to supports 141, funnel 132 is advanced in the direction of movement of the trays on the conveyor in response to the movement of piston rod 157*a*. Actuator 154 is activated by means (not shown) responsive to the advancement of cup 131 to a position adjacent the rest or starting position of funnel 132. At the same time actuator 158 is activated to advance the funnel in the direction of the line of travel of the containers.

Bracket 159, which is mounted on carriers 142 and 143 and links 159*a*, carries support 160 on which pawl 161 is pivotally mounted. The pawl 161 is biased in a downward direction by spring 162. The free end 161*a* of the pawl contains a notch which is adapted to engage flight 156 of the conveyor. The engagement of the pawl to the flight causes the advancing movement of the carriers 142 and 143 to be synchronized with that of the flight as the actuator 158 moves the carriers. Accordingly, the movement of funnel 132 is synchronized to the flight and thereby to the tray 133 being advanced by the flight.

Roller 163 is mounted on the end portion of carrier 143 adjacent bracket 159. As actuator 158 advances carrier 143 with respect to support rods 144, rotor 163 engages surface 164*a* of arm 164 which is pivotally mounted with respect to bracket 165 extending from frame member 146. The upward movement of arm 164 is transmitted to operating rod 166*a* of valve 166 which causes a reversal of actuator 154, thereby enabling the funnel 132 to be returned to its elevated position. In this way, the bottom portion of the funnel 132*a* is positioned clear of the tray and any material which has been delivered by the funnel to the tray.

At the end of the advancing stroke of actuator 158, plunger 167 extending from carrier 143 enters opening 146*a* and trips valve 168. Valve 168 then reverses actuator 158 thereby causing the elevated funnel 132 to be returned to its starting position where it can receive material from the next cup 131. Pawl 161 by virtue of its spring biasing can pass over the succeeding flight 156 and thereby be in a position for the next cycle of advancing the funnel in synchronism with the conveyor.

I claim:

1. In apparatus for delivering a predetermined amount of material at a predetermined location to each of a plurality of moving containers, the apparatus having:

a turntable pivotally mounted about a substantially vertical axis, the turntable being crowned with the periphery thereof disposed lower than the central portion thereof;

means for depositing a flow of material upon the turntable inwardly of the periphery thereof, the material being adapted to move radially outwardly over the periphery of the turntable as the turntable rotates;

means for rotating the turntable about its pivotal axis;

a plurality of hoppers;

means for mounting the plurality of hoppers spaced apart from one another with the mouth of each hopper facing upwardly beneath the periphery of the turntable;

means for moving the plurality of hoppers in the direction of rotation of the turntable to enable each of the plurality of hoppers to receive material moving radially outwardly over the periphery of the turntable;

means located at a predetermined arcuate extent about the periphery of the turntable from a location in advance of the depositing means in the direction of rotation of the turntable for releasing material from each of the plurality of hoppers successively to a different one of the plurality of moving containers, the moving of the plurality of hoppers from adjacent the depositing means to adjacent the releasing means enabling each hopper to receive the predetermined amount of material from the periphery of the turntable, the improvement comprising:

means disposed adjacent the means for releasing material from each of the plurality of hoppers for urging the flow of material released from each of the plurality of hoppers to enter successively a different one of the plurality of moving containers, and means for cylically advancing the urging means from adjacent the material releasing means toward and substantially in synchronism with the movement of each different successive one of the plurality of moving containers as the material is released thereinto and for cyclically reversing the urging means to return the urging means to adjacent the material releasing means.

2. The improvement of claim 1 in which the means for urging the flow of material to enter successively a different one of the plurality of containers comprises a vertically extending tubular element having an upper opening for receiving material being released from a hopper and a lower opening for directing the material into the container.

3. The improvement of claim 2 in which the tubular element is a funnel with the larger-opening thereof facing upwardly.

4. The improvement of claim 1 in which the improvement further comprises means for activating the means for successively advancing and reversing the urging means in response to the movement of a hopper to adjacent the material releasing means.

5. The improvement of claim 1 in which the means for successively advancing and reversing the urging means comprises means for reciprocating the urging means along the path of travel of the plurality of containers.

6. The improvement of claim 1 further comprising means for lowering the urging means from a predetermined elevated position toward the container during the releasing of material from a hopper and for subsequently elevating the urging means toward the predetermined elevated position.

7. The improvement of claim 5 further comprising means for synchronizing the successive advancing of the means for successively advancing and returning the urging means to the movement of the moving containers.

8. The improvement of claim 1 in which the apparatus has means for conveying the plurality of containers and in which the improvement further comprises means for synchronizing the advancing of the means for successively advancing and for successively reversing the urging means to the motion of the conveying means.

9. In apparatus for delivering a predetermined amount of material at a predetermined location to each of a plurality of moving containers, the apparatus having:

a plurality of hoppers;

means for mounting the plurality of hoppers spaced apart from one another;

means for moving the plurality of hoppers in the direction of movement of the plurality of containers;

means for delivering the predetermined amount of material to each of the plurality of hoppers;

means for releasing material from each of the plurality of hoppers successively to a different one of the plurality of moving containers, the improvement comprising:

means disposed adjacent the means for releasing material from each of the plurality of hoppers for urging the flow of material released from each of the plurality of hoppers to enter successively a different one of the plurality of moving containers, and means for cyclically advancing the urging means from adjacent the material releasing means toward and substantially in synchronism with the movement of each different successive one of the plurality of moving containers as the material is released thereinto and for cyclically reversing the urging means to adjacent the material releasing means.

10. The improvement of claim 9 in which the means for urging the flow of material to enter successively a different one of the plurality of containers comprises a vertically extending tubular element having an upper opening for receiving material being released from a hopper and a lower opening for directing the material into the container.

11. The improvement of claim 10 in which the tubular element is a funnel with the larger opening thereof facing upwardly.

12. The improvement of claim 9, further comprising means for activating the means for successively advancing and reversing the urging means in response to the movement of a hopper to adjacent the material releasing means.

13. The improvement of claim 9 in which the means for successively advancing and reversing the urging means comprises means for reciprocating the urging means along the path of travel of the plurality of containers.

14. The improvement of claim 13 further comprising means for synchronizing the successively advancing of the means for successive advancing and reversing the urging means to the movement of the moving containers.

15. The improvement of claim 9 in which the apparatus has means for conveying the plurality of containers and in which the improvement further comprises means for synchronizing the advancing of the means for successively advancing and for successively reversing the urging means to the motion of the conveying means.

16. In apparatus for delivering a predetermined amount of material at a predetermined location to each of a plurality of moving containers, the apparatus having:

means for releasing material from each of the plurality of hoppers successively to a different one of the plurality of moving containers, the improvement comprising:

means disposed adjacent the means for releasing material from each of the plurality of hoppers for urging the flow of material released from each of the plurality of hoppers to enter successively a different one of the plurality of moving containers, means for cylically advancing the urging means from adjacent the material releasing means toward and substantially in synchronism with the movement of each different successive one of the plurality of moving containers as the material is released thereinto and for cylically reversing the urging means to adjacent the material releasing means; and means for lowering the urging means from a predetermined elevated position toward the container during the releasing of material from a hopper and for subsequently elevating the urging means toward the predetermined elevated position.

17. In a method for delivering a predetermined amount of material to a predetermined location including the steps of:

providing a turntable which is pivotally mounted about a substantially vertical axis, the turntable being crowned with the periphery thereof disposed lower than the central portion thereof;

rotating the turntable about its pivotal axis; depositing a flow of material upon the turntable inwardly of the periphery thereof, the material being adapted to move radiall outwardly over the periphery of the turntable as the turntable rotates;

providing a plurality of hoppers spaced apart from one another with the mouth of each hopper facing upwardly beneath the periphery of the turntable;

moving the plurality of hoppers in the direction of rotation of the turntable to enable each of the plurality of hoppers to receive material moving radially outwardly over the periphery of the turntable; and releasing material from each of the plurality of hoppers, at a predetermined location which is a predetermined arcuate extent from the location at which the flow of material is deposited upon the turntable, the moving of the plurality of hoppers from adjacent the depositing means to the predetermined location adjacent to the releasing of the material from each hopper enabling each hopper to receive the predetermined amount of material from the periphery of the turntable, the improvement comprising the additional steps of positioning adjacent the predetermined location for releasing material from each of the plurality of hoppers a means for urging the flow of material released from each of the plurality of hoppers to enter successively a different one of a plurality of moving containers, and cyclically advancing the urging means from adjacent the predetermined location toward and substantially in synchronism with the movement of each different successive one of the plurality of moving containers as the material is released thereinto and cyclically reversing the urging means to return the urging means to adjacent the predetermined location.

18. A method in accordance with claim 17 in which the steps of positioning and cylically advancing the urging means toward and substantially in synchronism with the movement of each different successive one of the plurality of containers further comprises the step of urging the material into a vertically extending tubular element having an upper opening for receiving material being released from a hopper and a lower opening for directing the material into the container.

19. A method in accordance with claim 17 in which the step of cyclically advancing and cyclically reversing the urging means is in response to the movement of each of the plurality of moving containers to adjacent the predetermined location for releasing material.

20. A method in accordance with claim 17 in which the step of cyclically advancing and cyclically reversing the urging means comprises reciprocating the urging means along the path of travel of the plurality of containers.

21. A method in accordance with claim 17 and further comprising the step of vertically moving the urging means including lowering the urging means from a predetermined elevated position toward a container during the releasing of material from a hopper and for subsequently elevating the urging means toward the predetermined elevated position.

* * * * *

UNITED STATES PATENT AND TRADEMARK OFFICE

CERTIFICATE OF CORRECTION

PATENT NO. : 4,754,785

DATED : July 5, 1988

INVENTOR(S) : Bernard C. Eisenberg

It is certified that error appears in the above-identified patent and that said Letters Patent is hereby corrected as shown below:

Column 12, line 14, "larger-opening" to read -- larger opening --.

Column 13, line 24, "successively" to read -- successive --.

Column 13, line 25, delete "successive" and insert --successively--;

Column 13, line 47, delete "cylically" and insert --cyclically--;

Column 13, line 52, delete "cylically" and insert --cyclically--;

Column 14, line 40, delete "cylically" and insert --cyclically--;

Column 14, line 4, delete "radiall" and insert --radially--;

Signed and Sealed this

Twentieth Day of December, 1988

*Attest:*

DONALD J. QUIGG

*Attesting Officer*

*Commissioner of Patents and Trademarks*